US005179802A

United States Patent [19]

Higton

[11] Patent Number: 5,179,802

[45] Date of Patent: Jan. 19, 1993

[54] LOUVRE STRUCTURES

[75] Inventor: Peter A. Higton, Forest Row, United Kingdom

[73] Assignee: Hightons Arganisation Limited, West Sussex, United Kingdom

[21] Appl. No.: 659,373

[22] PCT Filed: Sep. 4, 1989

[86] PCT No.: PCT/GB89/01028

§ 371 Date: May 1, 1991

§ 102(e) Date: May 1, 1991

[87] PCT Pub. No.: WO90/02862

PCT Pub. Date: Mar. 22, 1990

[30] Foreign Application Priority Data

Sep. 2, 1988 [GB] United Kingdom ..... 8820793

[51] Int. Cl.[5] ..... E05F 17/00

[52] U.S. Cl. ..... 49/74; 49/51; 49/64; 49/403

[58] Field of Search ..... 49/74, 50, 51, 64, 403, 49/90

[56] References Cited

U.S. PATENT DOCUMENTS

| | | | |
|---|---|---|---|
| 1,050,010 | 1/1913 | Donnell | 49/90 X |
| 2,394,059 | 2/1946 | Hite | 49/403 X |
| 2,705,141 | 3/1955 | Postell | 49/90 X |
| 3,460,289 | 8/1969 | Toth | 49/50 |
| 3,928,937 | 12/1975 | Dovman | 49/403 |
| 4,481,734 | 11/1984 | Vaida | 49/74 X |
| 4,688,351 | 8/1987 | Torres | 49/74 |
| 4,694,608 | 9/1987 | Lambert | 49/50 |
| 4,724,634 | 2/1988 | Blum | 49/51 |
| 4,967,509 | 11/1990 | Storey et al. | 49/74 |

FOREIGN PATENT DOCUMENTS

| | | | |
|---|---|---|---|
| 41333 | 2/1971 | Australia . | |
| 1290329 | 3/1969 | Fed. Rep. of Germany . | |
| 2596802 | 10/1987 | France | 49/51 |
| 994000 | 6/1965 | United Kingdom . | |

*Primary Examiner*—Philip C. Kannan

[57] ABSTRACT

Louvre structures wherein holding members for the louvres are carried on bars which extend across a frame and are pivotally mounted with respect to the frame so as to be axially rotatable relative to the frame and which cannot be removed from the frame, at least when the window is installed.

5 Claims, 3 Drawing Sheets

LOUVRE STRUCTURES

This invention relates to louvre structures such as louvre doors and windows, hereinafter generally referred to as louvre windows, and more particularly to louvre windows with movable glass louvres.

The conventional louvre window comprises a, usually rectangular, frame and a plurality of louvres, normally parallel narrow panes of glass, arranged with their longitudinal edges overlapping. The louvres are usually mounted to be pivotable between a closed position of the window in which the overlapping edges of the louvres are in close contact and an open position in which the louvres are separated. The short edges of the louvres are generally supported in channel shaped holding members which are closed at the end which is lowest in the closed position, to prevent the louvres from falling out, which holding members are mounted for pivotal movement in the frame of the window, usually on a cylindrical boss which passes holding members through the frame on each side of the window. The bosses, at least on one side of the window usually carry a crank arm which is connected to a common activator means so that simultaneous movement of the louvres is achieved.

A serious security problem exists with such louvre windows in that, in order to prevent ingress of water the overlapping edge of one louvre over another must be on the outside of the window and thus, even when the window is closed the louvres can be removed by sliding them out of the holding members. By removing a number of louvres in this manner an opening that allows ingress into a building can be created without the risk of the sound of breaking glass raising an alarm.

This invention provides a louvre window structure that while it does not prevent removal or insertion of replacement louvres substantially overcomes this problem.

According to the invention the holding members for the louvres are carried on bars which extend across the frame and are pivotally mounted with respect to the frame so as to be axially rotatable relative to the frame and which cannot be removed from the frame, at least when the window is installed.

With the louvre structure of the invention, if the louvres are removed, the presence of the bars provides a barrier across the opening thereby preventing ingress through the opening without further effort in removing the bars. While a person determined to gain ingress could cut the bars this could be a time consuming and/or noisy operation. Moreover the presence of the bars can prevent removal of the louvres when the window is closed, since they may be positioned relative to the louvres as to limit the amount of movement of the louvres in their holding members, The holding members, as in the prior art, preferably comprise a U channel section closed at the end which normally faces downwards and open at the other end so that the edges of a louvre can be slidably received in the channel sections of the holding members of a preformed assembly, which is for example necessary when replacing broken louvres.

Preferably the holding members are made up of two cooperating portions that together define the channel section and which are rivetted or otherwise connected together so that the two portions can be separated to replace a louvre and then readily rejoined.

In a preferred form of the invention the holding members have a lateral flange forming an extension of the base of the channel section and preferably extending from a point inward of the closed end of the channel section, at least to the open end of the channel section. The flange has an aperture, preferably at a point substantially midway along the length of the channel section to receive the bar.

The portion of the flange between the bar receiving aperture and the end of the flange provides a crank arm. A connection may be made between the flanges, at least on one side of the window, to allow simultaneous pivoting of the louvres by means of an actuating lever which may be either attached to one of the flanges or if the flanges are fixed apart rotation relative to the bars, which may be arranged to rotate one of the bars. Preferably means are also provided for locking the window at a number of different degrees of opening for example by engagement of a peg on the actuating mechanism that engages with a notched arm on or attached to the frame.

The bars may be of any cross section. If the bars are not of circular cross section and the aperture in the flange is matched to the cross section of the bar, the bar and the holding member will rotate together thereby avoiding strain on the louvres on opening of the louvres. Preferably however the bars are of circular cross section and are rotatable relative to the holding member since there is then a tendency for a bar to rotate if any attempt is made to saw through it.

The bars are preferably made of stainless steel or some other material that is difficult to cut through.

The frame of the window may be of any conventional material such as timber or aluminium extrusion. The bars may be formed at their ends so as to be fully captive within the frame. The ends of the bar may, for example have a circumferential groove into which holding rods to bars may be fitted.

The invention will now be described in greater detail by way of example with reference to the drawings in which.

Figure 4:
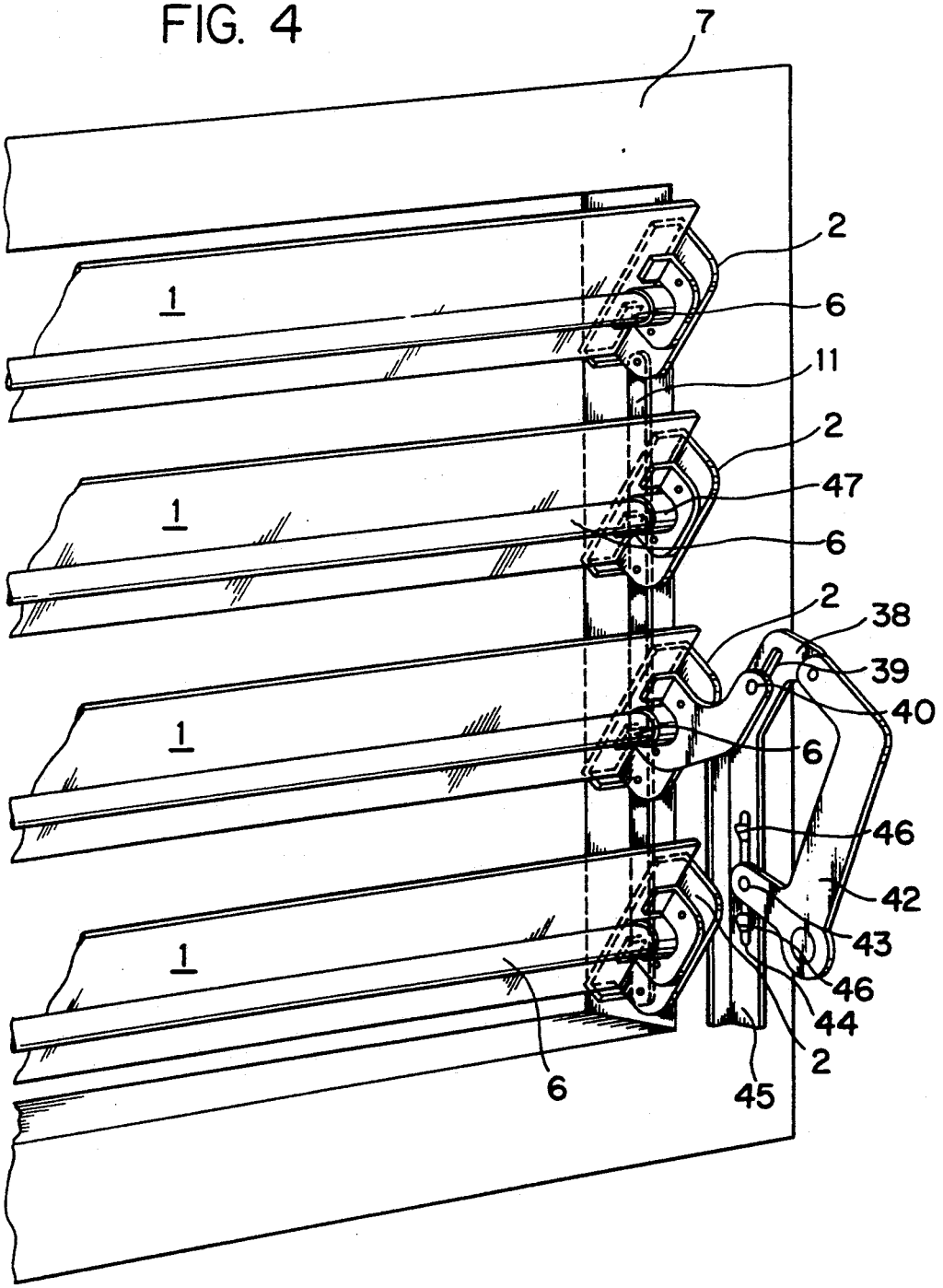
Figure 5:
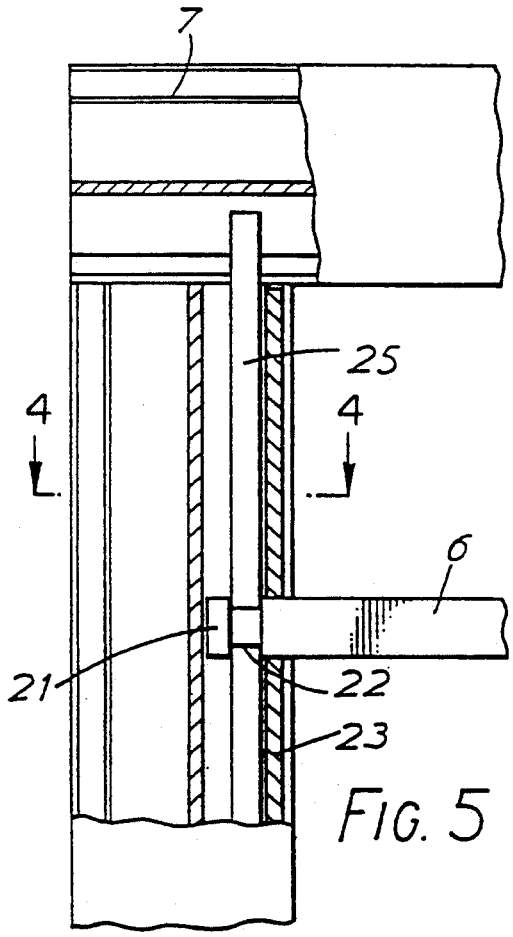
Figure 6:
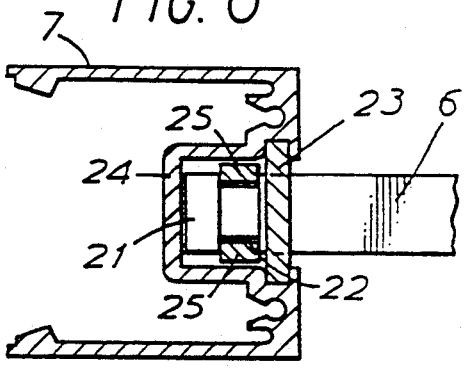
Figure 7:
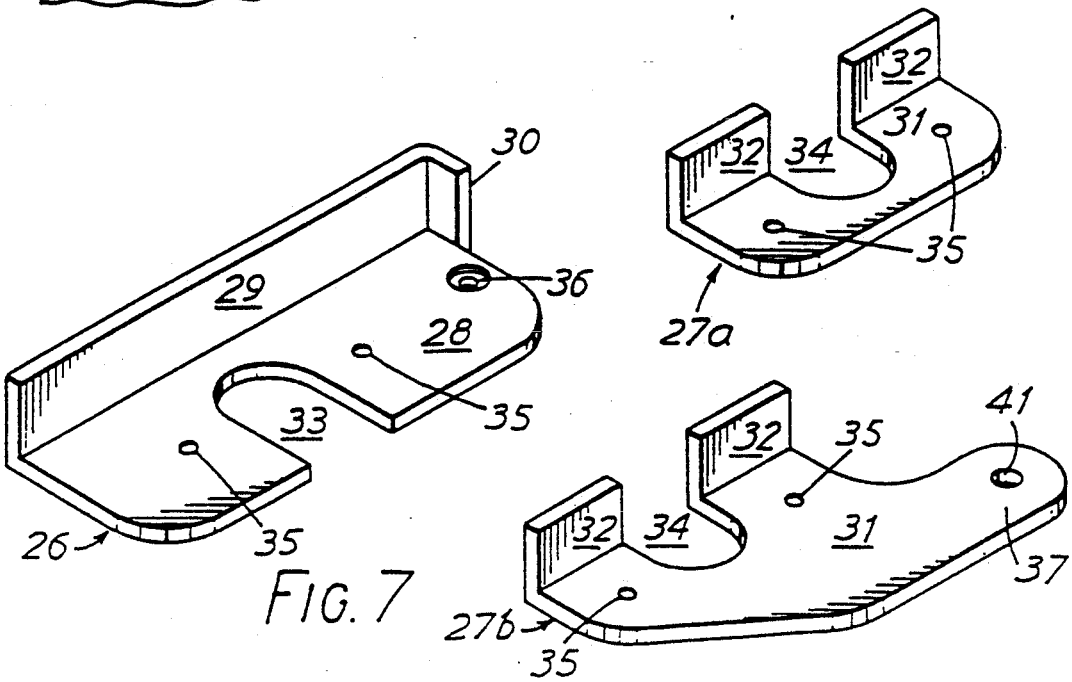

FIG. is a partial perspective view of a second form of window;

FIG. 5 is a fragmentary side section of the window of FIG. 4;

FIG. 6 is a section line 4—4 of FIG. 5;

FIG. 7 is an exploded view of an alternative form of holding member.

The glass louvres (1) of a window are received at their ends in holding member (2) formed of aluminium channel sections. The lower end of the channel sections (2) is closed at (3) to prevent the louvres (1) from sliding out of the holding members (2). The holding members (2) have a lateral flange (4) extending from a point inward of the closed end and formed such as to allow overlapping of adjacent holding members (2).

Approximately mid way along the channel section each flange (4) has a square aperture (5) to receive a square section bar (6) which extends completely across the window and the ends of which are received in the side frames (7). The ends of the bars (6) are received in nylon bushes (8). Each bush (8) has a circular bar receiving aperture of diameter substantially equivalent to the side length of the square bar (6) to allow rotation of bar (6) within the bush (8). A steel plate (9) having apertures (10) to receive the bushes is mounted inside the window frame (7).

The upper ends of flanges (4) on one side of the window are connected together by a metal strip (11) through pivot points (12) so that all the louvres will move simultaneously. A plate (13) is attached, for example by rivets (14) to one of the flanges (4) and extends beyond the flange (4) to which it is attached to form a crank arm. The plate (13) has a square opening (15) which slots over the relevant bar (6) such that movement of plate (13) in an upward or downward direction rotates that bar (6) and therefore causes the louvres to open or close. At its outer end plate (13) can be connected to an actuating rod (not shown).

Referring to FIGS. 4 to 7, the bars (6) in this form of the invention are of circular cross section. Towards there opposed ends (21) they are formed with a circumferential groove (22). Within the side frames of the window the bars pass through a pivot plate (23) having bar receiving apertures and retained in a recessed portion (24) of the frame by means of two elongate rods (25) that engage with the grooves (22) on diametrically opposed sides of the rods (6).

In this embodiment of the invention the louvre holding members (2) are formed from two cooperating pieces (26) and either (27*a*) or (27*b*). The piece (26) comprises a flat base (28) and a perpendicularly extending flange (29) on one edge. Flange (29) also extends partially around a second side of the base (28) to form a louvre retaining part (30). Pieces (27*a*) and (27*b*) also each comprise a base portion (31) and a perpendicularly extending upstanding flange (32). The pieces (26) and (27) have U-shaped portions (33) and (34), respectively, cut out of their bases (28) and (31), respectively such that when the two pieces (26) and (27) are placed with their bases (28) and (31), respectively, in contact and connected together, for example, by rivetting through holes (35) the cut out portions (33) and (34) together form a circular aperture to allow passage of the bar (6).

Figure 1:
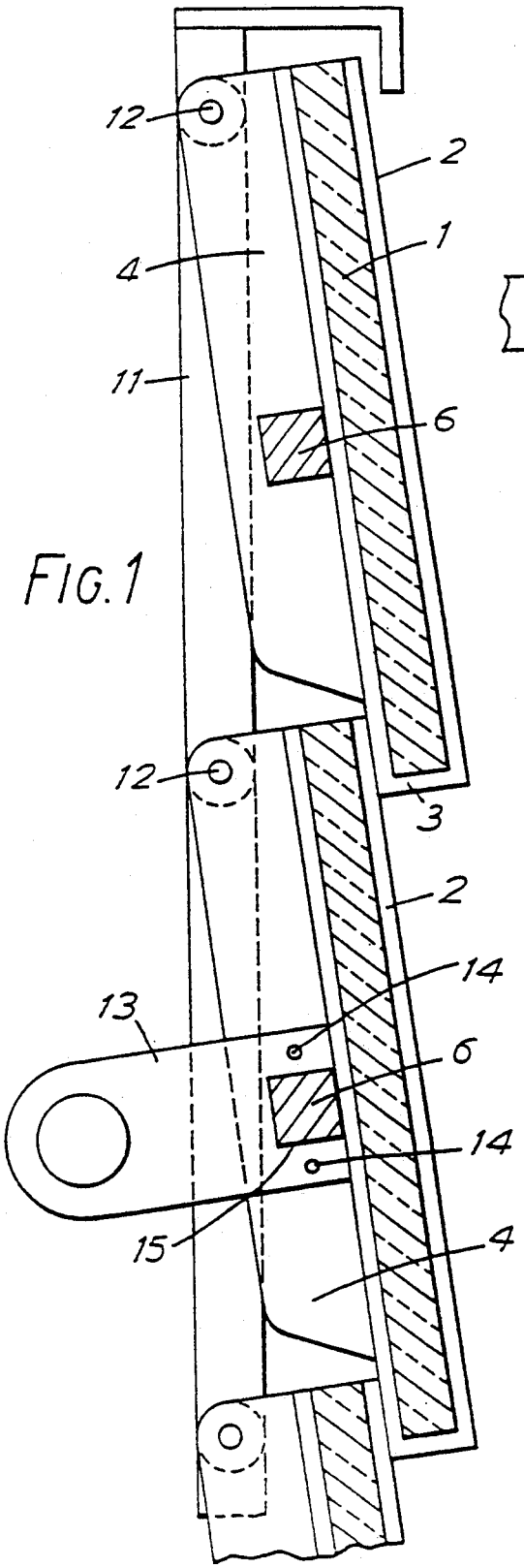
FIG. 1 is a fragmentary side section of one form of window according to the invention.
Figure 2:
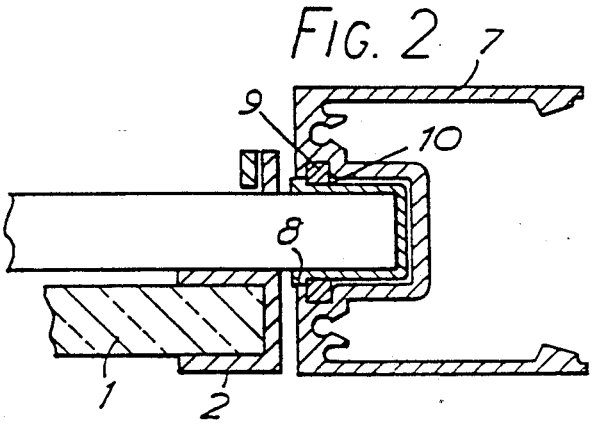
FIG. 2 is a fragmentary sectional plan view of the window shown in FIG. 1.
Figure 3:
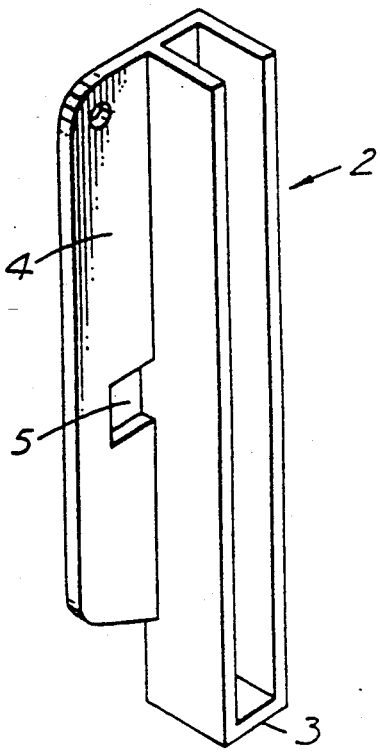
FIG. 3 is a perspective view of a holding member.

Piece (26), towards the end adjacent louvre retaining part (30) has a bore by means of which a number of the louvre holding members can be connected to a metal strip (11), as described with reference to FIGS. 1 to 3. The difference between pieces (27*a*) and (27*b*) consists in the provision of an extended portion (37) on piece (27*b*) for attachment to the actuating mechanism for opening the window. The actuating mechanism comprises a generally L-shaped first portion (38) having a elongated slot (39). A captive pin (40) passes through a hole (41) in the elongate portion (37) of piece (27*b*) and the slot (39) such that the pin (40) can slide freely in slot (39). Pivotally attached to the free end of L-shaped portion (38) is a generally U-shaped bracket (42), the pivotal attachment being made at the end of one of the arms of bracket (42). At the end of the other arm of bracket (42) is a pin (43) which is arranged to run in a slot (44) on an 'L' shaped bracket member (45) attached to the frame (7) of the window. The slot (44) has a number of upwardly extended notches (46) for receiving pin (43) to hold the window at various degrees of opening.

A collar (47) of nylon or other plastics material passes through the bar receiving apertures formed by cooperating "U" shaped portions (33,34) of the holding members (2) and the rods (6) are passed through these collars (47).

When the window is closed the louvres (1) cannot be slid out of the holding members (2) because after a certain amount of movement the upper edge of the louvre (1) is prevented from further upward movement by contact with the bar (6) on which the next louvre is mounted. Although the louvres (1) may be removed when the window is open the bars (6) form a barrier across the window opening.

I claim:

1. A louvre window structure comprising a generally rectangular frame and a plurality of rectangular louvre boards mounted relative to the frame to be pivotable between a closed position in which the longitudinal edges of the louvre boards overlap and are in close contact and an open position in which the louvre boards are separated, wherein each louvre board is mounted with its opposed shorter edges received in channel shaped holding members, said holding members for each louvre board are carried on a bar which extends across the frame and the ends of which are received in recesses in opposed frames members such that each bar is axially rotatable relative to the frame but is prevented from substantial linear movement so that the bars cannot be removed from the frame after the frame and bars structure has been assembled, and wherein the holding members on at least one side of the structure are connected together by a coupling member which is not connected to the frame and a louvre board actuating means is affixed to one only of the holding members whereby said louvre board associated with said holding member can be caused to pivot relative to the frame with the coupling means ensuring simultaneous movement of the remaining louvre boards between a closed and an open position is effected.

2. A louvre structure according to claim 1, wherein the holding members are made up of two cooperating portions that together define a channel section.

3. A louvre structure according to claim 1, wherein the holding members have a lateral flange forming an extension of the base of the channel section and having an aperture to receive the bar.

4. A louvre structure according to claim 1, wherein means are provided for locking the actuating mechanism at a plurality of open positions of the window structure.

5. A louvre structure according to claim 1 wherein the bars are of circular cross-section and are rotatable with respect to both the holding members and the frame.

* * * * *